US005405045A

United States Patent [19]

Usmani

[11] Patent Number: 5,405,045

[45] Date of Patent: Apr. 11, 1995

[54] TIME CONTROLLED CIGARETTE DISPENSER

[76] Inventor: Arif S. Usmani, P.O. Box 3174, Skokie, Ill. 60076

[21] Appl. No.: 162,230

[22] Filed: Dec. 6, 1993

[51] Int. Cl.[6] ..... B65G 47/00

[52] U.S. Cl. ..... 221/7; 221/8; 221/15; 221/76; 221/85; 221/197

[58] Field of Search ..... 221/2, 3, 7, 8, 15, 221/12, 76, 84, 85, 121, 122, 197

[56] References Cited

U.S. PATENT DOCUMENTS

| | | | |
|---|---|---|---|
| 2,809,083 | 10/1957 | Goodyear | 221/76 |
| 2,818,970 | 1/1958 | Pough | 221/76 |
| 2,819,814 | 1/1958 | Hatch | 221/15 |
| 4,127,190 | 11/1978 | Sunnen | 221/2 |
| 4,572,403 | 2/1986 | Benaroya | 221/3 |
| 4,869,394 | 9/1989 | Hurst | 221/7 |
| 5,310,082 | 5/1994 | Coustenoble | 221/2 |

FOREIGN PATENT DOCUMENTS

| | | | |
|---|---|---|---|
| 1050937 | 3/1979 | Canada | 221/15 |
| 1226330 | 3/1971 | United Kingdom | 221/15 |

*Primary Examiner*—H. Grant Skaggs

[57] ABSTRACT

A device for allowing the dispensing of cigarettes at a predetermined rate comprising a drum and a plurality of chambers for receiving individual cigarettes, the drum having an open upper end and a plate at the lower end; a container of a size to receive the drum; a cover pivotally attached to the cylindrical container at the upper end and movable between an open position for loading cigarettes, the cover also including a lid at the delivery position openable to allow removal of a single cigarette; a locking assembly to maintain the cover closed except when in the load orientation; drive mechanisms to sequentially bring each chamber beneath the lid for cigarette removal; and control means to activate the drive mechanisms in a time sequence.

8 Claims, 5 Drawing Sheets

FIG 9
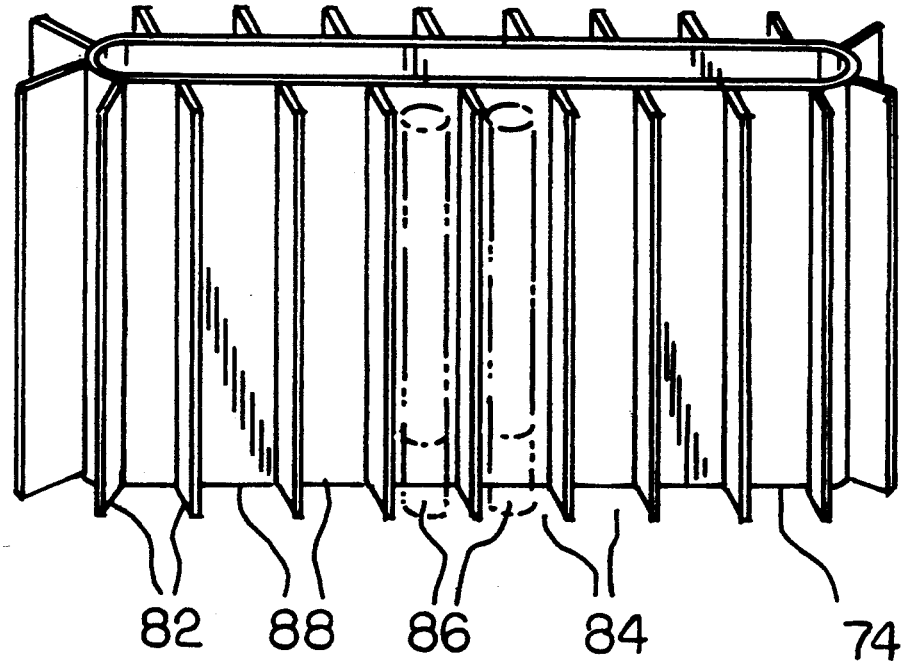
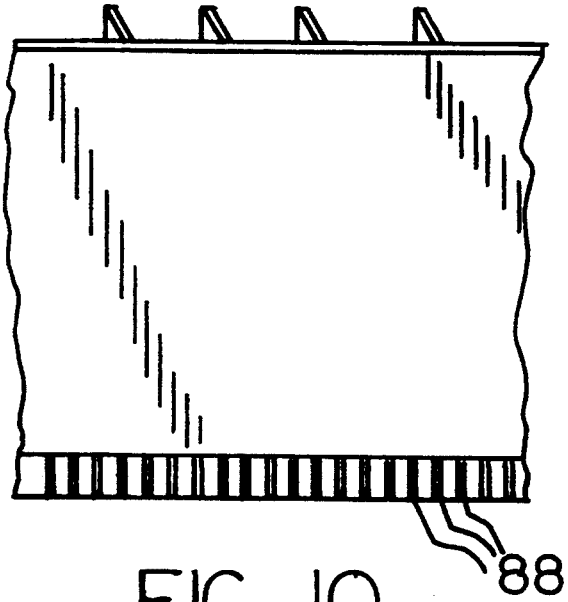
FIG 10

TIME CONTROLLED CIGARETTE DISPENSER

BACKGROUND OF THE INVENTION

1. Field of the Invention

The present invention relates to time controlled cigarette dispenser and more particularly pertains to a device for dispensing individual cigarettes in a manner to assist the user in the abatement of smoking.

2. Description of the Prior Art

The use of time controlled dispensers is known in the prior art. More specifically, cigarette dispensers heretofore devised and utilized for the purpose of smoking abatement are known to consist basically of familiar, expected and obvious structural configurations, notwithstanding the myriad of designs encompassed by the crowded prior art which have been developed for the fulfillment of countless objectives and requirements.

By way of example, U.S. Pat. Nos. 3,722,746 to Kieves and 4,278,185 to Perez disclose devices for dispensing cigarettes through mechanical components activated by a user. U.S. Pat. Nos. 4,082,202 to Newsome and 4,556,154 to Bajtala relates to cigarette dispensers with more complex control mechanisms including electrical components. Lastly, U.S. Pat. No. 4,010,869 to Adamo discloses a dispenser for cigarettes designed for dissuading smokers from using cigarettes.

In this respect, the time controlled cigarette dispenser according to the present invention substantially departs from the conventional concepts and designs of the prior art, and in so doing provides an apparatus primarily developed for the purpose of smoking abatement.

Therefore, it can be appreciated that there exists a continuing need for new and improved devices for dispensing cigarettes which can be used for the abatement of smoking. In this regard, the present invention substantially fulfills this need.

SUMMARY OF THE INVENTION

In view of the foregoing disadvantages inherent in the known types of dispensers now present in the prior art wherein the same can be utilized for the dispensing in a time controlled manner the present invention provides an improved method and apparatus for the abatement of smoking. As such, the general purpose of the present invention, which will be described subsequently in greater detail, is to provide a new and improved time controlled cigarette dispenser and method which has all the advantages of the prior art cigarette dispensers and none of the disadvantages.

To attain this, the present invention essentially comprises a device for dispensing cigarettes at a time controlled rate as an aid for the abatement of smoking, the device comprising, in combination, a cylindrical drum having a central vertical axis for rotation thereabout and twenty vertically disposed chambers for receiving individual cigarettes located around the periphery of the cylinder, the drum having an open upper end and a plate at the lower end, the plate having an upper surface for supporting the lower end of the received cigarettes, the plate having a lower surface for support by drive mechanisms and peripheral gear teeth; a cylindrical container of a size to receive the drum, the cylinder having an open upper end and a closed lower end for receiving thereabove drum drive mechanisms and control components; a cover pivotally attached to the cylindrical container at the open end movable between an open position for loading cigarettes into the chambers and a closed position for use, the cover also including a lid pivotally secured to the cover at a delivery position and openable to allow removal of a single cigarette at the delivery position; a locking assembly adapted to maintain the cover closed with respect to the container except when in the loading orientation, the locking assembly including a peripheral ridge extending outwardly from adjacent to the upper edge of the drum with a single clearance slot, the locking assembly also including a locking hook secured to the cover in contact with the lower surface of the ridge to preclude opening of the cover except when in the loading orientation; drive mechanisms located in the lower region of the container beneath the drum, the drive mechanisms including a gear cooperable with the gear teeth to rotate the drum in a step and repeat manner and sequentially position each chamber beneath the lid for cigarette removal, a motor to drive the gear and a battery to power the motor; and control mechanisms to power to the motor in a time sequence as determined by a user, the control mechanisms also including buttons to shorten the length of the cycle of movement of the drum, and an on/off switch and light, and an indicator panel to indicate the number of cigarettes cycled through the system at any particular time.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved time controlled cigarette dispenser which has all the advantages of the prior art time controlled cigarette dispensers and none of the disadvantages.

It is another object of the present invention to provide a new and improved time controlled cigarette dispenser which may be easily and efficiently manufactured and marketed.

It is a further object of the present invention to provide a new and improved time controlled cigarette dispenser which is of a durable and reliable construction.

An even further object of the present invention is to provide a new and improved time controlled cigarette dispenser which is susceptible of a low cost of manufacture with regard to both materials and labor, and which accordingly is then susceptible of low prices of sale to the consuming public, thereby making such dispensers economically available to the buying public.

Still yet another object of the present invention is to provide a new and improved time controlled cigarette dispenser which provides in the apparatuses and methods of the prior art some of the advantages thereof, while simultaneously overcoming some of the disadvantages normally associated therewith.

Still another object of the present invention is to provide a new and improved device for dispensing cigarettes at a predetermined rate comprising a cylindrical drum rotatable about a central vertical axis and a plurality of vertically disposed chambers for receiving individual cigarettes located around the periphery of the cylinder, the drum having an open upper end and a plate at the lower end, the plate having an upper surface for supporting the lower end of received cigarettes, the plate also having a lower surface for being supported by drive mechanisms; a cylindrical container of a size to receive the drum, the cylindrical container having an open upper end and a closed lower end for receiving thereabove drive mechanisms and control components; a cover pivotally attached to the cylindrical container at the upper end and movable between an open position for loading cigarettes into the chamber in a closed position for use, the cover also including a lid at the delivery position openable to allow removal of a single cigarette at the delay position; a locking assembly to maintain the cover closed with respect to the container except when in the loading orientation; drive mechanisms located in the lower region of the container beneath the drum to rotate the drum in a step and repeat manner to sequentially bring each chamber beneath the lid for cigarette removal; and control means to activate the drive mechanisms in a time sequence as determined by the user.

Yet another object of the present invention is to help smokers reduce their smoking or stop smoking all together.

Even still another object of the present invention is to assist smokers in reducing the number of cigarettes smoked by allowing them to become available only after the passage of a predetermined time from the smoking of a prior cigarette.

Another object of this invention is to make it, as light and small in size as possible for easy carrying by the user, and preferably to give this invention a shape and a size that is carriable in pocket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a perspective view of the belt of the FIG. 7 embodiment.

FIG. 10 is a bottom view of a portion of the belt taken along line 10—10 of FIG. 9.

DESCRIPTION OF THE PREFERRED EMBODIMENT

Figure 1:
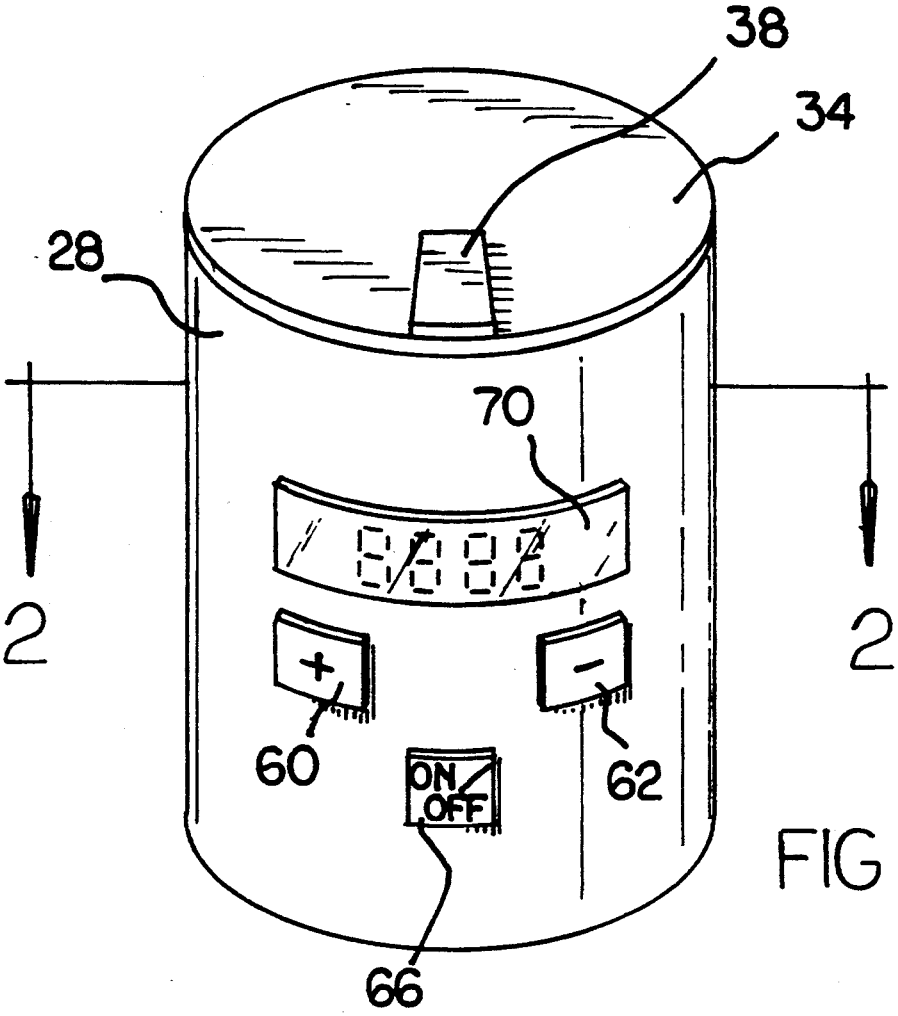
FIG. 1 is a perspective illustration of a time controlled cigarette dispenser constructed in accordance with the principles of the present invention.
Figure 2:
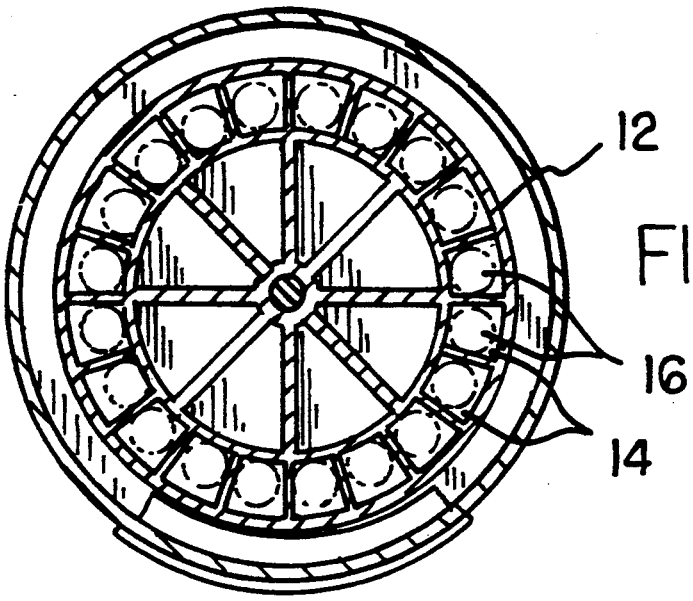
FIG. 2 is sectional view of the device of FIG. 1 taken along line 2—2 of FIG. 1.

With reference now to the drawings, and in particular to FIG. 1 thereof, a new and improved time controlled cigarette dispenser embodying the principles and concepts of the present invention and generally designated by the reference numeral 10 will be described.

Figure 3:
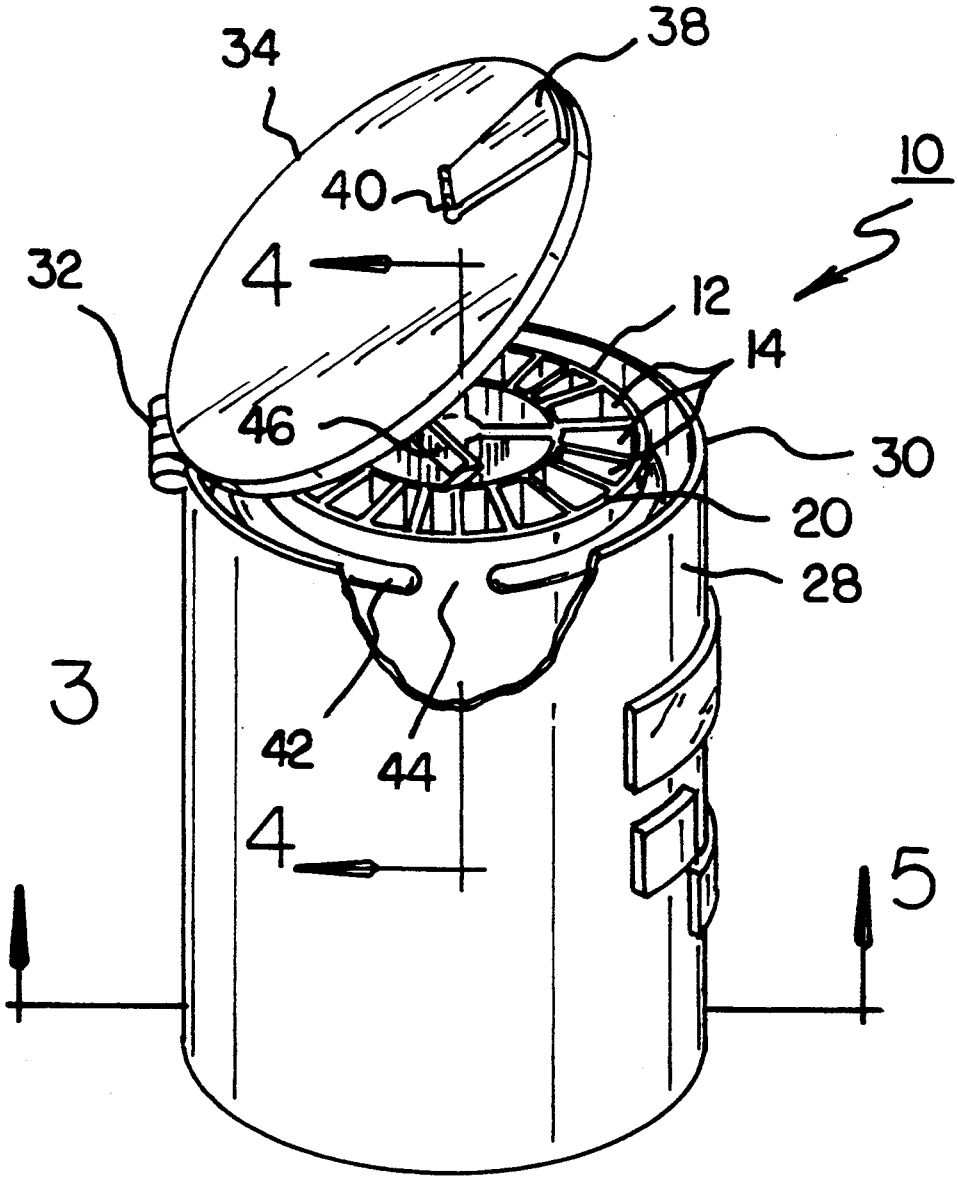
FIG. 3 is a perspective view of the device shown in FIG. 1 but with the cover open and parts broken away to show certain internal constructions.
Figure 4:
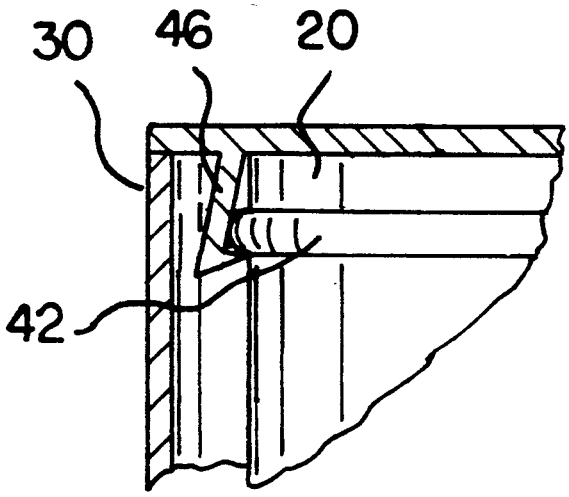
FIG. 4 is a sectional view taken along line 4—4 of FIG. 3 but with the cover closed.
Figure 5:
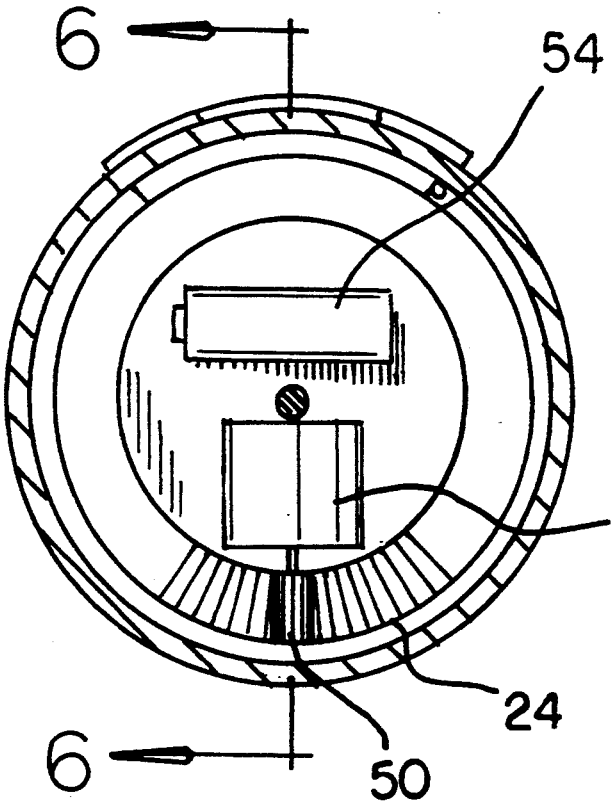
FIG. 5 is a sectional view of the device of the prior Figures taken along line 5—5 of FIG. 1.
Figure 6:
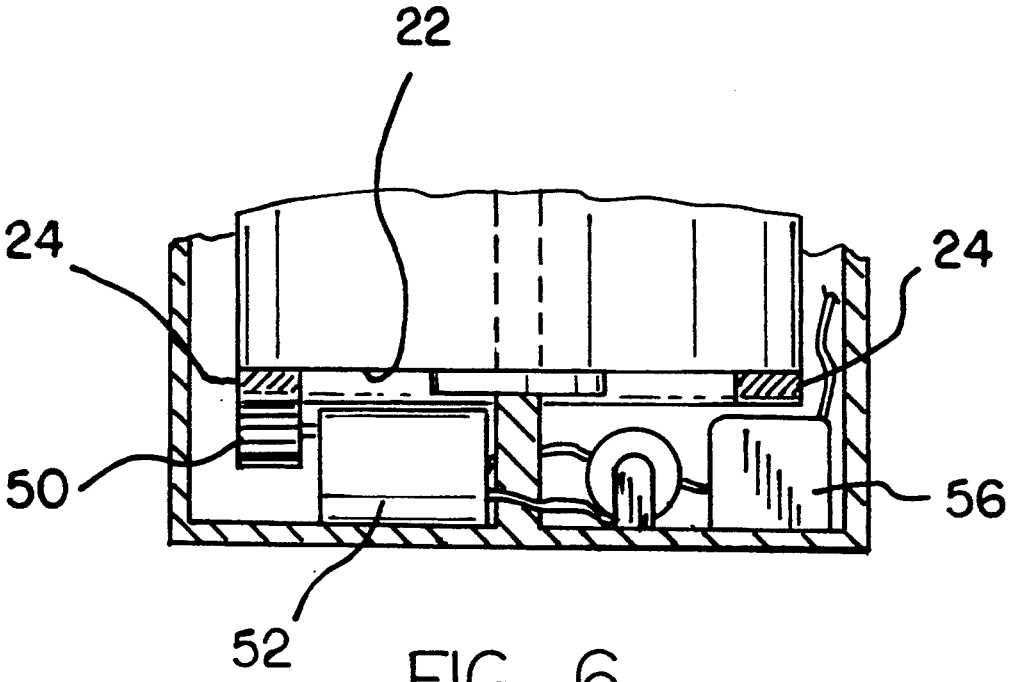
FIG. 6 is a sectional view of the device of the prior Figures taken along line 6—6 of FIG. 5.

More specifically, it will be noted with particular reference to FIGS. 1 and 3, there is disclosed a device 10 for dispensing cigarettes at a controlled rate. The dispensing of cigarettes to a smoker at a controlled rate is an aid for most smokers in reducing the number of cigarettes smoked and, hopefully for the stopping of smoking entirely. Whether it is cigarette stopping or reducing of use, the physical benefits are well known.

The central component of the dispensing device 10 is a cylindrical drum 12. The drum has a central vertical axis about which the drum is mounted for rotation. Disposed around the periphery of the drum are a plurality of chambers 14. The chambers are preferably twenty in number corresponding to the number of cigarettes normally found in a pack. The chambers 14 are vertically disposed of a length essentially the length of a cigarette 16 or slightly longer. They are of a cross sectional size so as to receive the cigarettes located therein.

The drum has an open upper end 20 and, at the lower end an imperforate plate 22. The plate has an upper surface for supporting the lower end of the received cigarettes. The lower surface of the plate is for receiving therebeneath the drive mechanisms including peripheral gear teeth 24 at the exterior edge of the lower surface of the plate 22.

The drum 12 is received in a cylindrical container 28 of a length at least as long as the length of the drum. It has a central axis co-extensive with the central axis of the drum. The upper end 30 of the cylinder is opened and a closed lower end is provided for receiving thereabove the drive mechanisms and control components of the device, as will be described in greater detail hereinafter.

Attached by a hinge 32 to the cylindrical container 28 at its upper end is a cover 34. The cover is movable between an open position whereby the entire upper surface of the drum 12 is exposed. In this position, the individual chambers 14 of the drum 12 may be loaded with the cigarettes 16 to be dispensed. The cover 34 is movable to a closed position for use when cigarettes 16 are being dispensed.

The cover 34 also includes a lid 38 secured to the cover 34 by a hinge 40. The lid 38 and cover 34 do not rotate, and the lid is always located at a delivery position, the position from which cigarettes are dispensed or, more accurately, a delivery position where the lid 38 may be opened and, the sufficient time has elapsed since the last cigarette was dispensed, the user may withdraw the cigarette from the next chamber.

Cooperatively associated between the container 28 and cover 34 is a locking assembly. The locking assembly functions to maintain the cover 34 closed and locked with respect to the container 28 except when the drum 12 has rotated to the loading orientation at which time all cigarettes have been removed and it is time to load the chambers 14 with an additional pack of cigarettes. The locking assembly includes a peripheral ridge 42 extending outwardly from adjacent the upper edge of the drum. A single clearance slot 44 is formed with respect to the ridge 42. The ridge cooperates with a locking hook 46 downwardly extending from the interior face of the cover 34. The locking hook 46 thus secures the cover 34 in contact with the lower surface of the ridge 42 to preclude the smoker from opening the cover for a cigarette prior to the passage of time from the smoking of the last cigarette.

Located in the lower region of the container are the drive mechanisms. They are located immediately beneath the drum 12 and include a rotatable gear 50 cooperable with the gear teeth 24 of the plate 22 to rotate the drum 12 in a step and repeat manner. This is for sequentially positioning each chamber 14 one at a time beneath the lid 38 for cigarette removal when appropriate. A motor 52 is located to drive the gear 50 and a battery 54 functions to power the motor 52. Together these components make up the drive mechanism.

The last assembly of the dispenser device is the control mechanisms 56. The control mechanisms 56 function to power the motor 52 in a time sequence as determined by a user. The control mechanisms 56 also include buttons 60 and 62 marked with plus and minus to lengthen or shorten the cycle of movement of the drum 12. This is so that the user may determine a longer time between cigarettes or a shorter time.

An additional component of the control mechanisms is an on/off switch and light 66. The on/off switch and light 66 is depressed to energize the dispenser at which time the button 66 which is a light becomes illuminated. It is also depressed again to turn off the light and inactivate the motor as for example when the user is going to bed and sleep for an extended period of time without smoking.

The last component is the indicator panel 70 powered by the controller 56 to give a read-out of the time programmed by the operator between cigarettes and to indicate the number of cigarettes used and/or the number of cigarettes remaining in the container. Other items of information could be programmed into the controller as is desired for a particular application.

In operation and usage, the user finds the apparatus 10 with the on/off light 66 inactivated and hence no power to the drive mechanisms. The drum 12 is automatically rotated to the dispensing orientation so that the cover 34 may be lifted and a pack of cigarettes added individually to the individual chambers 14. The cover 34 is then closed and the on/off switch 66 pressed to provide power to the operating and control mechanisms. At this time the operator may press the plus button 60 one or a plurality of times to increase the time between dispensing of cigarettes. In the alternative, the user may depress the minus button 62 one or a plurality of times to decrease the time between the dispensing of a cigarette. The time between cigarettes is electronically displayed on the indicator panel 70. Also displayed is the number of cigarettes available and the number of cigarettes used.

The first cigarette 16 is then taken from the beneath the lid 38 and the lid reclosed. The timer of the controller 56 will then begin to count the pre-selected time until the movement of the drum to bring the next cigarette 16 and chamber 14 beneath the lid 38. At this time the cigarette counter indexes one to show eighteen cigarettes available and two smoked. This continues on a regular bases throughout the day until all cigarettes are used. A rapid advance to the next cigarette 16 is not possible because once a time-plan is selected, it can not be changed or altered during that particular cycle and the lifting of the cover 34 is also impossible due to the relationship of the hook 46 with respect to the slot 44 ridge 40 and 42. An alarm, or any indicator such as light, will sound when the cigarette is in delivery position ready for use. Upon the drum presenting the twentieth and last cigarette at the dispensing position, the on/off light 66 will be inactivated and power will be removed from the system. In this orientation the slot 44 is located in alignment with the hook 46 to allow the lifting of the cover 34 for the loading of the next pack of cigarettes. This is followed by the depressing of the on/off button 66 all in a continuous and automatic cycle of operation designed to effect the objective of helping smokers abate their use of cigarettes.

Figure 7:
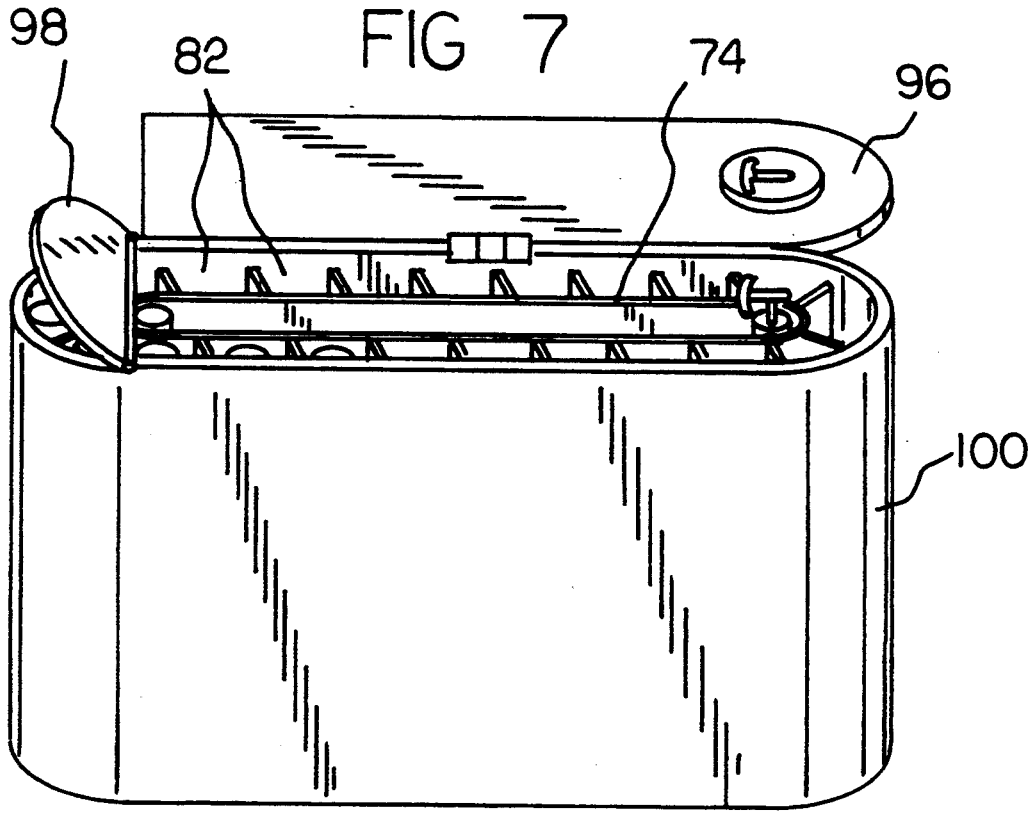
FIG. 7 is a perspective view of a time controlled cigarette dispenser similar to the primary embodiment of the prior Figures but illustrating an alternate embodiment of the invention.
Figure 8:
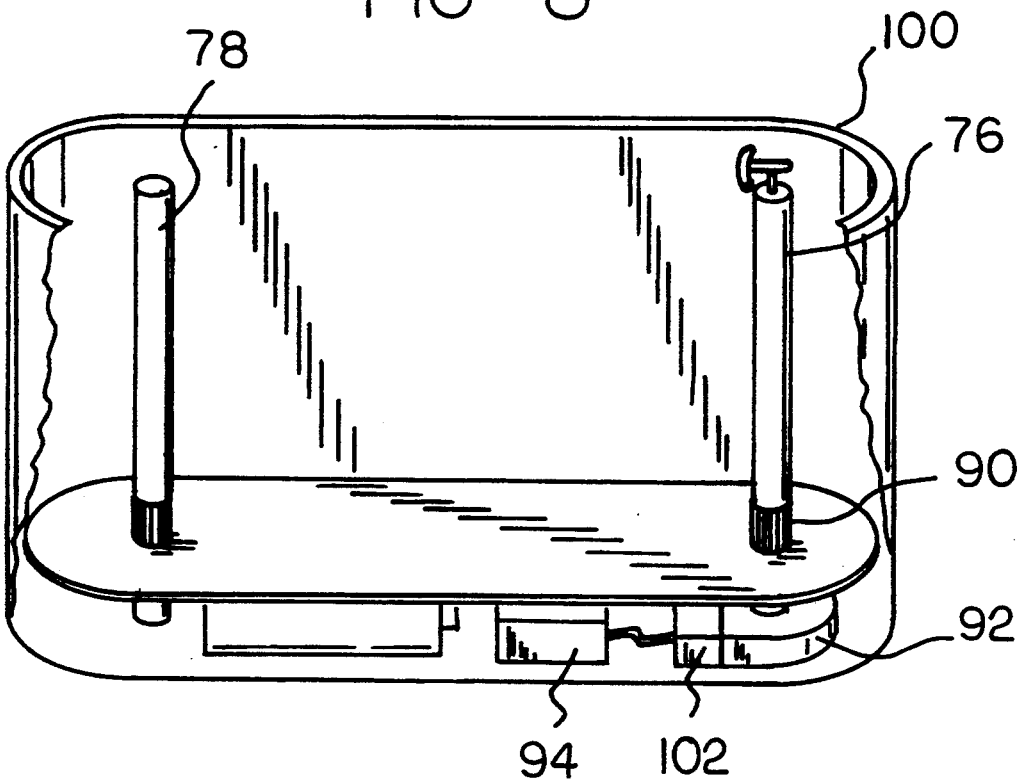
FIG. 8 is a perspective view of the dispenser of FIG. 7 but with parts broken away and the belt removed to show certain internal constructions.

An alternate embodiment of the invention is shown in FIGS. 7 and 8. In such embodiment, the cylindrical drum is replaced by a cylindrical belt 74 supported in a generally oval configuration. Such belt is trained around two parallel shafts, a driven shaft 76 and an idler shaft 78. The belt thus has two semicircular extents around the rollers and two elongated parallel extents therebetween. The support for the cigarettes is a belt in a generally oval cross section rather than a drum with a circular cross section. The axis of rotation of the belt is centrally located between the axes of the rollers. The belt has vertical plates 82 extending radially outward from the belt to define chambers 84 therebetween for individual cigarettes 86. The lower edge of the belt is formed with teeth 88 engagable with gear teeth 90 driven by a motor 92 in a manner similar to that of the prior embodiment.

A relatively flat and generally oval shaped container 100 is sized and shaped to receive the belt 74, plates 82 and cigarettes 86 as well as the drive mechanisms 94. The lower face of the container is closed as is the upper face except for a pivotally coupled large cover 96 over the majority of the cover for loading cigarettes and a pivotally coupled small cover 98 over one of the rollers for dispensing cigarettes. As in the prior embodiment, the controls 94 allow the loading cover 96 to be opened only after the last cigarette has been dispensed while the dispensing cover 98 may be opened only after a predetermined lapsed time following the dispensing of the prior cigarette.

In this embodiment, as may also be employed in the prior embodiment, an alarm 102 preferably in the form of a small bell is employed in association with the controls to signal the user that the predetermined time has passed and the next cigarette is available for being dispensed. Other types of alarms may be utilized as for example a buzzer, a vibrator, a lamp, etc.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A device for dispensing cigarettes at a time controlled rate as an aid for the abatement of smoking, the device comprising, in combination:

a cylindrical drum having a central vertical axis for rotation thereabout and twenty vertically disposed chambers for receiving individual cigarettes located around the periphery of the cylinder, the drum having an open upper end and a plate at the lower end, the plate having an upper surface for supporting the lower end of the received cigarettes, the plate having a lower surface for support by drive mechanisms having peripheral gear teeth;

a cylindrical container of a size to receive the drum, the cylinder having an open upper end and a closed lower end for receiving thereabove drum drive mechanisms and control components;

a cover pivotally attached to the cylindrical container at the open end movable between an open position for loading cigarettes into the chambers and a closed position for use, the cover also including a lid pivotally secured to the cover at a delivery position and openable to allow removal of a single cigarette at the delay position;

a locking assembly adapted to maintain the cover closed with respect to the container except when in the loading orientation, the locking assembly including a peripheral ridge extending outwardly from adjacent to the upper edge of the drum with a single clearance slot, the locking assembly also including a locking hook secured to the cover in contact with the lower surface of the ridge to preclude opening of the cover except when in the loading orientation;

drive mechanisms located in the lower region of the container beneath the drum, the drive mechanisms including a gear cooperable with the gear teeth to rotate the drum in a step and repeat manner and sequentially position each chamber beneath the lid for cigarette removal, a motor to drive the gear and a battery to power the motor; and control mechanisms to power the motor in a time sequence as determined by a user, the control mechanisms also including buttons to shorten the length of the cycle of movement of the drum, and an on/off switch and light, and an indicator panel to indicate the number of cigarettes cycled through the system at any particular time.

2. A device for allowing the dispensing of cigarettes at a predetermined rate comprising:

a cylindrical support rotatable about a central vertical axis and a plurality of vertically disposed chambers for receiving individual cigarettes located around the periphery of the support, each chamber being of a vertical length several times longer than the horizontal width for supporting a cigarette, the support having an open upper end and gear teeth associated with the lower end;

a cylindrical container of the size to receive the support, the cylindrical container having an open upper end and a closed lower end for receiving thereabove drive mechanisms and control components;

a cover pivotally attached to the cylindrical container at the upper end and movable between an open position for loading cigarettes into the chamber and a closed position for use, the cover also including a lid at the delivery position openable to allow removal of a single cigarette at the delay position;

a locking assembly having a component on the cover and a component in the container, the components being selectively interrelated to maintain the cover closed with respect to the container except when in the re-load orientation;

drive mechanisms located in the lower region of the container beneath the support to rotate the support in a step and repeat manner to sequentially bring each chamber beneath the lid for cigarette removal; and control means to activate the drive mechanisms in a time sequence as determined by the user.

3. The device as set forth in claim 2 wherein the locking assembly includes a peripheral ridge extending outwardly from adjacent the upper edge of the support with a single clearance slot, the locking assembly also including a locking hook secured to the cover in contact with the lower face of the ridge to preclude opening of the cover except when in the delivery position.

4. The device as set forth in claim 2 wherein the drive mechanisms include a motor with a gear, a cooperable gear on the lower surface of the plate, and a battery to power the motor.

5. The device as set forth in claim 2 wherein the control mechanisms include buttons to shorten or lengthen the cycle of movement of the drum, an on/off switch and light, an indicator panel to indicate the number of cigarettes cycled through the system at any particular time.

6. The device as set forth in claim 2 wherein the support is a drum with a circular cross section.

7. The device as set forth in claim 2 wherein the support is a belt with a generally oval cross section.

8. The device as set forth in claim 2 and further including signal device to produce a signal when a cigarette is brought to position for being dispensed.

* * * * *